United States Patent [19]

Bosworth et al.

[11] 4,073,260

[45] Feb. 14, 1978

[54] APPARATUS FOR REMOVING CROSS WELDS FROM METAL TUBES AND MARKING THE SAME

[75] Inventors: Clive J. Bosworth; Neil E. Bridgstock, both of Kettering; Raymond S. Stone, Corby; William L. McLaughlin, Kettering, all of England

[73] Assignee: British Steel Corporation, London, England

[21] Appl. No.: 677,868

[22] Filed: Apr. 19, 1976

[51] Int. Cl.[2] ..... B05C 5/00

[52] U.S. Cl. ..... 118/8; 29/33 D; 29/407; 83/293; 83/371; 118/35

[58] Field of Search ..... 118/8, 35, 300; 83/293, 83/294, 295, 371, 370; 29/33 D, 33 T, 33 B, 407

[56] References Cited

U.S. PATENT DOCUMENTS

| | | | |
|---|---|---|---|
| 3,290,167 | 12/1966 | Wood et al. | 118/8 X |
| 3,760,667 | 9/1923 | Maxey et al. | 83/371 X |
| 3,807,261 | 4/1974 | Couvreur | 83/295 X |
| 3,892,153 | 7/1975 | Kato | 83/295 X |

*Primary Examiner*—John P. McIntosh
*Attorney, Agent, or Firm*—Bacon & Thomas

[57] ABSTRACT

Cross welds in metal tube moving continuously along a path are removed by means of a method which includes the sequential steps of generating signals representative of predetermined linear movements of the tube, detecting the presence of cross welds in the tube and, on detecting the presence of such cross welds, passing signals to a counter device which is operable after receiving a predetermined number of these signals to actuate a cutting device which removes the cross weld from the tube.

3 Claims, 3 Drawing Figures

APPARATUS FOR REMOVING CROSS WELDS FROM METAL TUBES AND MARKING THE SAME

This invention relates to apparatus for removing cross welds from metal tube.

In the manufacture of tube from metal strip material, the tail end of one coil of strip material is butt welded to the leading end of another coil to produce a substantially continuous length of strip material which is conveyed to a forming and welding line to produce the finished tube. The butt welds between successive coils appear in the final tube as cross-welds.

According to the present invention in one aspect, a method of removing cross welds from metal tube moving continuously along a path comprises the steps of generating signals representative of predetermined linear movements of the tube, detecting the presence of cross welds in the tube and, on detecting one of the same, passing said signals to counter means operable after receiving a predetermined number of said signals to actuate cutting means to remove from the moving tube a length containing the detected cross-weld.

According to the present invention in another aspect, apparatus for removing cross welds from metal tube moving continuously along a path comprises means for detecting the presence of cross welds in the tube, counter means connected to receive from pulse generating means signals representative of predetermined linear movements of the tube and operable in response to a cross weld being detected by said detection means to actuate, cutting means for removing from said tube a length containing said detected cross weld. The cross weld detection means may comprise two or more probes positioned about the circumference of the moving tube and operable simultaneously to relay signals to said counter means upon a cross weld being detected. Two counter means may be provided, one operable after receiving a first predetermined number of signals to energise a first cutter to sever the tube a predetermined distance in front of a detected cross weld and the other operable after receiving a second predetermined number of signals to energise a second cutter to sever the tube a predetermined distance behind the detected cross weld. The pulse generating means may comprise a wheel which rotates in contact with the surface of the moving tube, and includes a number of evenly spaced apertures formed in its circumference, a light source in communication with said apertures, and means to transmit a signal on each occasion that an aperture passes across the face of said light source.

The invention will now be described by way of example with reference to the accompanying diagrammatic drawings in which:

FIG. 1, schematically illustrates a tube forming and welding line including apparatus for removing cross welds in accordance with the invention;

Figure 1:
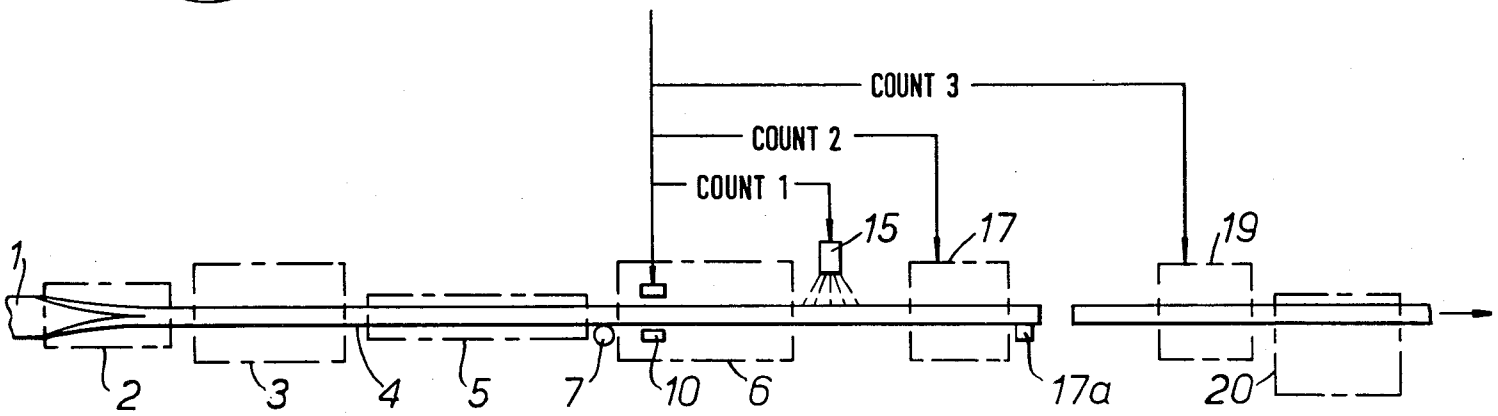
Figure 3:
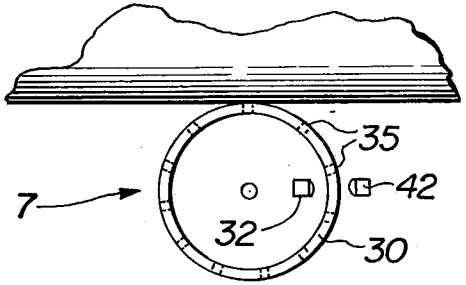
FIG. 3 is a schematic illustration of a pulse generator.

In the forming and welding line illustrated in FIG. 1, metal strip material 1 (e.g. steel strip) from one of a series of coils (not shown) is conveyed to forming stands 2 and a welding stand 3 in which it is, respectively, shaped and welded to form tube 4. The tube is passed through a cooling trough 5 before entering sizing stands 6 in which it is rolled to size. A pulse generator 7 comprising a hardened steel wheel 30 which runs along the undersurface of the tube is positioned at entry to the sizing stands 6. A solid state light source 32 is mounted within the wheel 30 of the pulse generator 7 and a plurality of equally spaced apertures 35 are formed in the circumference of the wheel 30. The apertures 35 pass pulses of light to detectors 42. As will be seen from FIG. 2, the light source of the pulse generator 7 is connected to pass to a normally closed electronic gate 9 a train of pulses corresponding to the frequency with which the apertures formed in the circumference of the wheel of the pulse generator, pass the light source. It will be appreciated that on each occasion that a pulse is passed from the generator 7 to the gate 9, the tube will have moved a predetermined linear distance along the forming and welding line. Thus, for a wheel having a circumference of 60 cm and 60 equally spaced apertures, each pulse represents 1 cm of linear movement of the tube away from the pulse generator 7.

As the tube 4 passes between adjacent rolls of the sizing stands 6, its surface is scanned by a pair of probes 10 spaced about the circumference of the tube which detect flaws in the surface of the tube and pass signals upon such flaws being detected to the electronic gate 9. Each probe 10 may comprise a pad which scans the surface of the tube and includes a number of electrical coils which induce eddy currents within the scanned surface. As the probe traverses a weld, the weld material disturbs the normally balanced eddy currents and the resulting imbalance causes a signal to be transmitted to the gate 9. When a cross weld is traversed by the probes each probe simultaneously transmits a signal to the gate 9; when coincident signals are received, the gate 9 opens to enable pulses to pass from the pulse generator 7 to counters 11, 12, 13. Counter 11 is programmed to actuate a relay 14 after receiving a number of pulses corresponding to the distance along the forming and welding line, between the probes 10 and a spray gun 15 mounted at the exit from the sizing stands 6. Actuation of the relay 14 energises the spray gun 15 for a predetermined time interval, to mark the position of the detected cross weld on the surface of the tube. After energisation of the spray gun 15, the counter 11 is reset to zero.

The counter 12 is programmed to actuate after receiving a set number of pulses from the pulse generator 7 a relay 16 which energises a first cutting machine 17 to sever the tube 4 a predetermined distance in front of the detected cross weld. The number of pulses is equivalent to the distance between the probes 10 and the cutting machine 17 less the aforementioned predetermined distance. The counter 13 is programmed to actuate a relay 18 after receiving a different set number of pulses from the pulse generator 7 which energises a second cutting machine 19 to sever the tube 4 at a predetermined distance behind the detected cross weld. The number of pulses in this instance is equivalent to the distance between the probes 10 and the cutting machine 19 plus the last mentioned predetermined distance. Energisation of the cutting machines 17, 19 causes the machines to travel along with the tube 4 as the shears of the machine cut through the tube 4. The shears may comprise a series of disc cutters, twin shears or flying shears. Operation of the relays 16, 18, therefore, results in a predetermined length (say 6 inches) of tube containing the detected cross weld, being removed from the tube. After actuation of the cutting machines 17, 18 the counters 12, 13 are reset to zero and the gate 9 closed. Lengths removed from the tube 4 are collected in a scrap bin 20. The length of tube removed can be varied by means of a device 21 which can increase the programmed length of counter 13 by predetermined steps of, for example, 15 cm.

Figure 2:
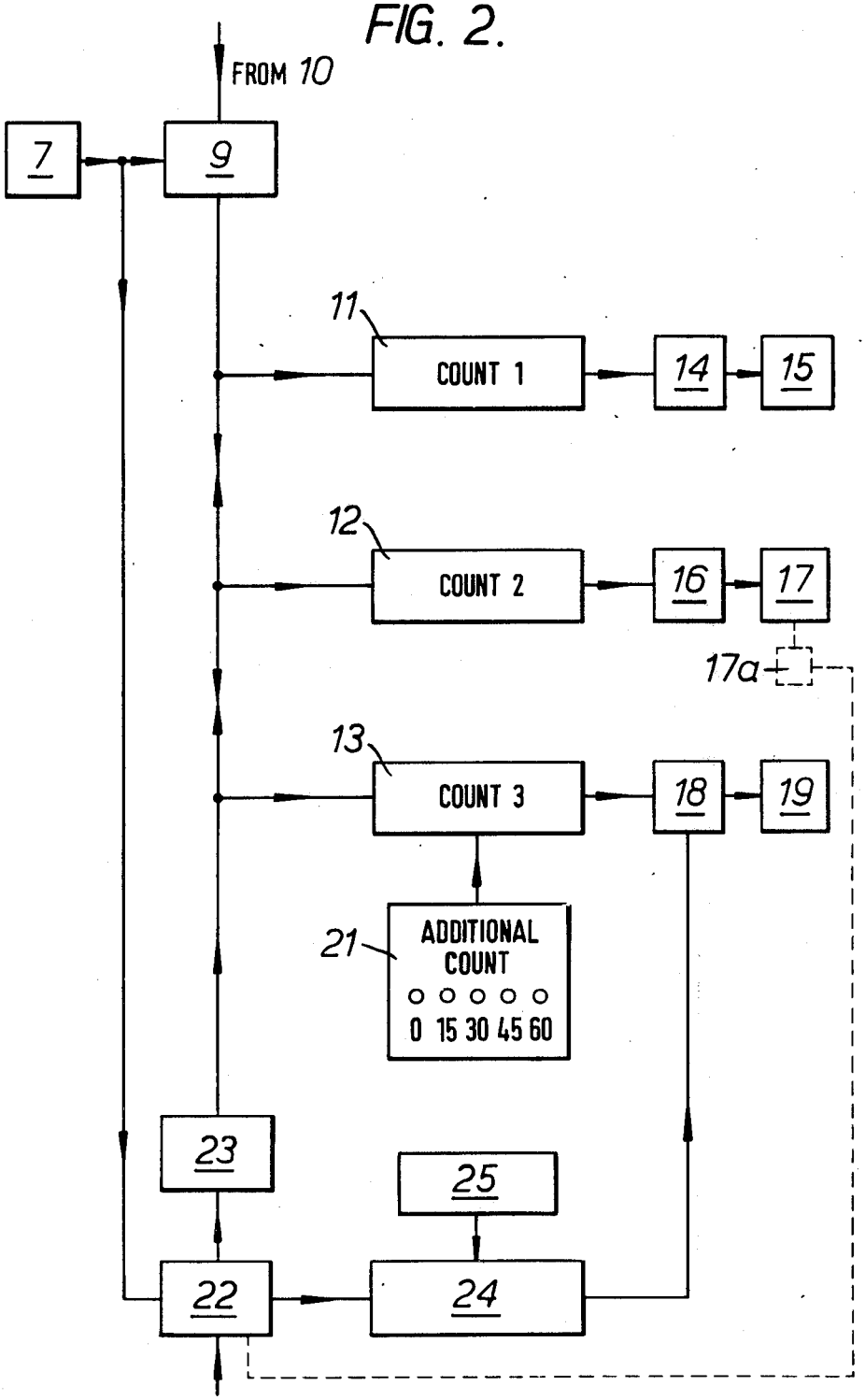
FIG. 2, is a block diagram which illustrates in greater detail the apparatus for removing cross welds illustrated in FIG. 1.

The apparatus illustrated in FIG. 2 also enables sample lengths of tube to be removed from the nose of the tube.

Initially, cutting machine 17 is operated manually to remove a length from the nose of the tube. Manual operation of machine 17 actuates a switching device 17*a* to open an electronic gate 22 to allow pulses to pass to an inhibiting device 23 to inhibit the passage of pulses from the gate 9. Pulses from the pulse generator 7 pass from the gate 22 to a counter 24 which is programmed by a device 25 to operate the relay 18 and cutting machine 19 after receiving a predetermined number of pulses to give the required sample length. The number of pulses is equivalent to the distance from between the switching device 17*a* and and the cutting machine 19.

In an unillustrated embodiment, a single cutting machine is employed which includes two linearly spaced apart cutters or shears. In this embodiment, actuation of the relay 16 causes the cutting machine to move along with the tube and to remove the required length from the tube.

We claim:

1. Apparatus for removing cross welds from a metal tube moving continuously longitudinally along a path, comprising: means for detecting the presence of cross welds in the tube, cutting means operable to sever said tube, pulse generating means for generating signals representative of predetermined linear movements of the tube, counter means connected to receive pulses from the pulse generating means, and operable in response to a cross weld being detected by said detection means and thereafter in response to a predetermined number of signals being received to actuate said cutting means for removing from said tube a length containing said detected cross weld, said detection means comprising at least two probes positioned about the circumference of the moving tube and operable only simultaneously to relay a signal to said counter means upon a cross weld being detected.

2. Apparatus as claimed in claim 1 in which the pulse generating means comprises a wheel which rotates in contact with the surface of the moving tube and includes a number of evenly spaced apertures formed in its circumference, a light source in communication with each of said aperture and means to transmit a signal on each occasion that an aperture passes across the face of said light source.

3. Apparatus as claimed in claim 1 wherein an additional counter means is provided which is energised upon a cross weld being detected to operate a spray gun to mark the presence of the cross weld as it passes said spray gun.

* * * * *